US007006045B2

(12) United States Patent
Takebe

(10) Patent No.: US 7,006,045 B2
(45) Date of Patent: Feb. 28, 2006

(54) PORTABLE TRANSCEIVER ANTENNA

(75) Inventor: Hiroyuki Takebe, Tokyo (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 10/468,889

(22) PCT Filed: Feb. 26, 2002

(86) PCT No.: PCT/JP02/01721

§ 371 (c)(1),
(2), (4) Date: Aug. 26, 2003

(87) PCT Pub. No.: WO02/069442

PCT Pub. Date: Sep. 6, 2002

(65) Prior Publication Data

US 2004/0070542 A1 Apr. 15, 2004

(30) Foreign Application Priority Data

Feb. 26, 2001 (JP) ..... 2001-050118

(51) Int. Cl.
*H01Q 1/24* (2006.01)

(52) U.S. Cl. ..... 343/702

(58) Field of Classification Search ..... 343/702, 343/700 MS, 895

See application file for complete search history.

(56) References Cited

U.S. PATENT DOCUMENTS 5,760,745 A 6/1998 Endo et al. ..... 343/702
5,905,467 A 5/1999 Narayanaswamy et al. . 343/702
6,255,994 B1 * 7/2001 Saito ..... 343/700 MS
6,268,830 B1 * 7/2001 Nakagawa et al. ..... 343/702
6,445,347 B1 * 9/2002 Yoshimi ..... 343/702
6,498,586 B1 * 12/2002 Pankinaho ..... 343/700 MS
6,535,166 B1 * 3/2003 Ali ..... 343/700 MS

FOREIGN PATENT DOCUMENTS

| | | |
|---|---|---|
| EP | 1 061 603 A2 | 12/2000 |
| JP | 1-105237 U | 7/1989 |
| JP | 2-149003 A | 6/1990 |
| JP | 4-304201 A | 11/1992 |
| JP | 4-336803 A | 11/1992 |
| JP | 314201 A | 11/1992 |
| JP | 5-167324 A | 7/1993 |
| JP | 6-209204 A | 7/1994 |

* cited by examiner

*Primary Examiner*—Wilson Lee
*Assistant Examiner*—Huedung X. Cao
(74) *Attorney, Agent, or Firm*—Birch, Stewart, Kolasch & Birch, LLP

(57) ABSTRACT

It is an object to provide a portable wireless communication apparatus antenna, which is slidable relative to a casing and completely retractable in the casing and which has the same wideband characteristic when it is retracted as when it is extended. The antenna comprises a first antenna element slidable relative to the casing and a second antenna element fixedly disposed in the casing, wherein the lower end part of the first antenna element when it is retracted and the upper end part of the second antenna element are arranged to be adjacent to each other, thereby coupling the capacitance to form an antenna system as a unit.

8 Claims, 10 Drawing Sheets

PORTABLE TRANSCEIVER ANTENNA

This application is the national phase under 35 U.S.C. § 371 of PCT International Application No. PCT/JP02/01721 which has an International filing date of Feb. 26, 2002, which designated the United States of America.

TECHNICAL FIELD

The present invention relates to a retractable and extensible antenna for a portable wireless communication apparatus, mounted on a portable wireless communication apparatus.

BACKGROUND ART

In recent years, various mobile communications using quasi-microwave bands via portable wireless communication apparatus such as mobile phones are in the spotlight, and there is an increasing need not only for voice communications but also for data, image, and other types of communications. Therefore, the shapes of casing for portable wireless communication apparatus are diverse, depending on individual applications for use, such as long, straight types and folding types. As antennas mounted on portable wireless communication apparatus of these types, those that can be extended when in use and can be retracted when not in use are in actual use.

FIG. 1 is a view showing one example of a portable wireless communication apparatus having a conventional portable wireless communication apparatus antenna. The portable wireless communication apparatus shown in FIG. 1 comprises a wireless communication apparatus main body 112 having a printed board, a shield, a battery, a display portion, a key portion, and a microphone receiver, most of which are electrically conductive. It also includes a resin casing 111 for fixing the wireless communication apparatus main body 112, and a retractable and extensible antenna 113 mounted on the upper part of the casing 111.

The antenna 113 has a first antenna 114 having conductivity and a second antenna 116 including a coil disposed at the upper end of the first antenna via an insulator. An extension connection portion 114*a* that is connected to an antenna holder 117 fixed to the casing when the antenna is extended is provided at the lower end part (end part which is inserted into the casing) of the first antenna 114. A retraction connection portion 116*a* that is connected to the antenna holder 117 fixed to the casing when the antenna is retracted is provided at the lower end part (end part facing the first antenna) of the second antenna 116.

The antenna holder 117 is connected to the wireless communication apparatus main body 112 through a feeding terminal 118 including a spring and further connected to a matching circuit 119 in the wireless communication apparatus main body 112. When the antenna 113 is extended, the extension connection portion 114*a* is connected to the antenna holder 117 and the bar-shaped first antenna 114 is fed through the matching circuit 119 so that it operates as an antenna. At the same time, the second antenna 116 is not fed and therefore does not operate as an antenna due to the presence of the insulator 115.

In contrast, when the antenna 113 is retracted, the connection portion 116*a* is connected to the antenna holder 117 and so the coil-like second antenna 116 is fed through the matching circuit 119 to operate as an antenna protruding from the casing. At the same time, the retracted first antenna 114 is not fed due to the presence of the insulator 115, and does not operate as an antenna.

As described above, while being used, the antenna 113 is extended so that the bar-shaped first antenna 114 having good antenna characteristics can operate. When the wireless communication apparatus is carried around, the coil-like second antenna 116 operates with somewhat poorer antenna characteristics but smaller in size.

FIG. 2 is a view showing another example of a portable wireless communication apparatus having a conventional portable wireless communication apparatus antenna.

The portable wireless communication apparatus antenna shown in FIG. 2 includes a wireless communication apparatus main body 122 mostly constituted by conductive members, a resin casing 121 for mounting the wireless communication apparatus main body 122. It also includes a bar-shaped antenna 124 having connection terminals 124*a* and 124*b* at the upper and lower parts thereof, and an antenna holder 127 fixed to the casing 121 for holding the extended or retracted antenna 124 while at the same time connecting the antenna to a matching circuit 129 in the wireless communication apparatus main body 122 through a feeding terminal 128. The antenna further includes a retraction correction circuit 125 provided in the casing 121.

In this portable wireless communication apparatus, when the antenna is extended, the lower connection terminal 124*b* is connected to the antenna holder 127 and the antenna 124 protrudes, so that the antenna is fed through the matching circuit 129 in the wireless communication apparatus main body 122 to operate as a bar-shaped antenna.

In contrast, when the antenna is retracted, the upper connection terminal 124*a* is connected to the antenna holder 127 so that the antenna is fed through the matching circuit 129 in the wireless communication apparatus main body 122. At the same time, the lower connection terminal 124*b* is connected to the retraction correction circuit 125 in the casing. The retraction correction circuit 125 corrects impedance variations when the antenna is placed adjacent to the wireless communication apparatus main body 122 in the casing. Accordingly, it is possible to use the same matching circuit 129 not only when the antenna 124 is extended but also when retracted.

In recent years, there is a strong need for portable wireless communication apparatus to transmit not only voice but also data, images, and the like, and thus diversified casing shapes suitable therefor are needed. In the meantime, in order to increase the transmission speed and subscriber capacity, wider band communications are desired. To meet these requirements, such an antenna as is suitable for various casing shapes, has no protruding part when retracted, and has excellent portability and wideband characteristics when retracted is required.

In the case of the portable wireless communication apparatus shown in FIG. 1, the second antenna including a coil protrudes out of the casing when the antenna is retracted, causing a nuisance when the portable wireless communication apparatus is carried in a pocket or the like. Further, when the antenna is mounted to a broad casing like a notebook PC or a PDA, the antenna protrudes even when retracted, thus causing a remarkable damage to portability. It is necessary to upsize the second antenna in order to achieve wider antenna bandwidths when it is retracted, and this also causes a remarkable damage to the portability.

The portable wireless communication apparatus shown in FIG. 2 has no protruding part when the antenna is retracted, as described above, so that it provides very excellent portability and is applicable to casings of any shape. However, while the antenna is retracted, the antenna must be placed adjacent to or surrounded by the wireless communication apparatus main body, etc. constituted by conductive members in the casing. Therefore, the antenna volume decreases and the frequency characteristics become narrower even if matching is achieved by a retraction correction circuit as in the conventional example.

The present invention has been achieved in view of the forgoing. It is an object of the invention to provide a portable wireless communication apparatus antenna that is completely retractable and suitable for diversified casing shapes, and that has wideband characteristics suitable for large capacity transmission.

DISCLOSURE OF THE INVENTION

A portable wireless communication apparatus antenna of the present invention comprises: a casing for housing a wireless communication apparatus portion; a first antenna element which can be extended and retracted by sliding movement relative to the casing and that is connected to the wireless communication apparatus portion both when extended and when retracted; and a second antenna element fixedly disposed in the casing, which is placed adjacent to the first antenna element in a non-contact condition when the first antenna element is retracted.

This enables the retracted first antenna element and the second antenna element to operate integrally as an antenna, ensuring the antenna volume and realizing good antenna characteristics even when retracted.

The second antenna element may be an antenna element having both ends opened and an electric length of substantially ½ the wavelength of an operating frequency. The second antenna element thereby resonates near the operating frequency and double resonance occurs together with the first antenna element, so that the frequency band becomes wide.

The second antenna element may be an antenna element having a short circuit at one end and an electric length of substantially ¼ the wavelength of an operating frequency. An open end of the element is placed adjacent to one end part of the first antenna element in a non-contact condition. The second antenna element thereby resonates near the operating frequency and a double resonance occurs together with the first antenna element, so that the frequency band becomes wide.

There are provided: a casing for housing a wireless communication apparatus portion; a first antenna element, which can be extended and retracted by sliding movement relative to the casing and can be connected to the wireless communication apparatus portion both when extended and when retracted; a frequency conversion means fixedly disposed in the casing and electrically connected to the first antenna element when the first antenna element is retracted; and a second antenna element fixedly provided in the casing and disposed adjacent to the frequency conversion means in a non-contact condition.

This configuration can adjust the frequency when the first antenna element is retracted and can change the impedance at a point of double resonance together with the second antenna element.

The frequency conversion means is a capacity loading means mounted to a shield of the wireless communication apparatus portion, and thereby, when the first antenna element is retracted, the capacity loading means loads the capacitance on the tip of the first antenna element, so that the resonance frequency of the first antenna element can be reduced.

The frequency conversion means is an electrically neutral additional conductor, and thereby, when the first antenna element is retracted, the additional conductor is connected to the lower end part of the first antenna element to increase the physical length of the antenna, so that the resonance frequency of the first antenna element can be reduced.

The casing comprises two members that are openable via a hinge, and the first or second antenna element is provided on the side face of one of the two members. When the two members overlap, the first or second antenna element provided on the side face is placed so as to protrude related to the other of the two members, so that the first and second antenna elements protrude from the other member, thereby preventing reduction of the antenna volume.

The specification includes parts or all of the contents as disclosed in the specification and/or drawings of Japanese Patent Application No. 2001-50118, which is a priority document of the present application.

BEST MODE FOR CARRYING OUT THE INVENTION

Figure 1:
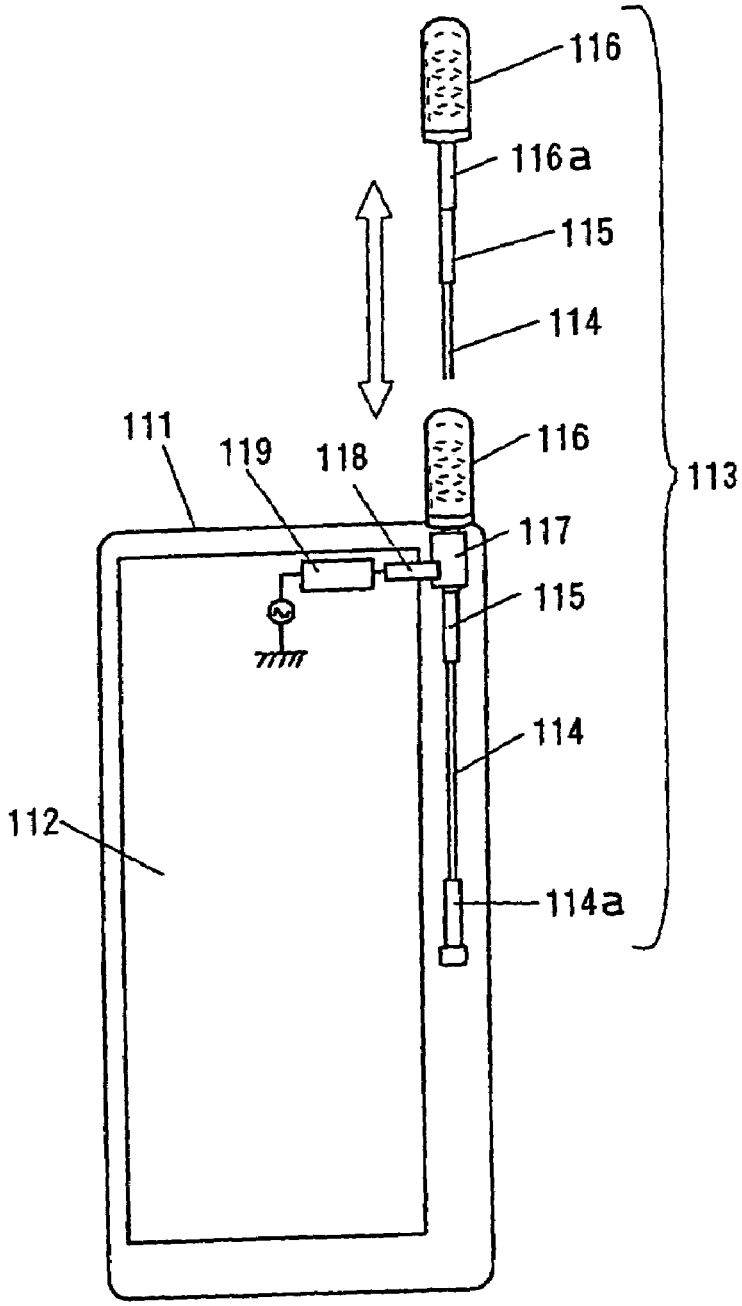
CONVENTIONAL ART FIG.1
FIG. 1 is a view showing an example of a portable wireless communication apparatus having a conventional portable wireless communication apparatus antenna.
Figure 2:
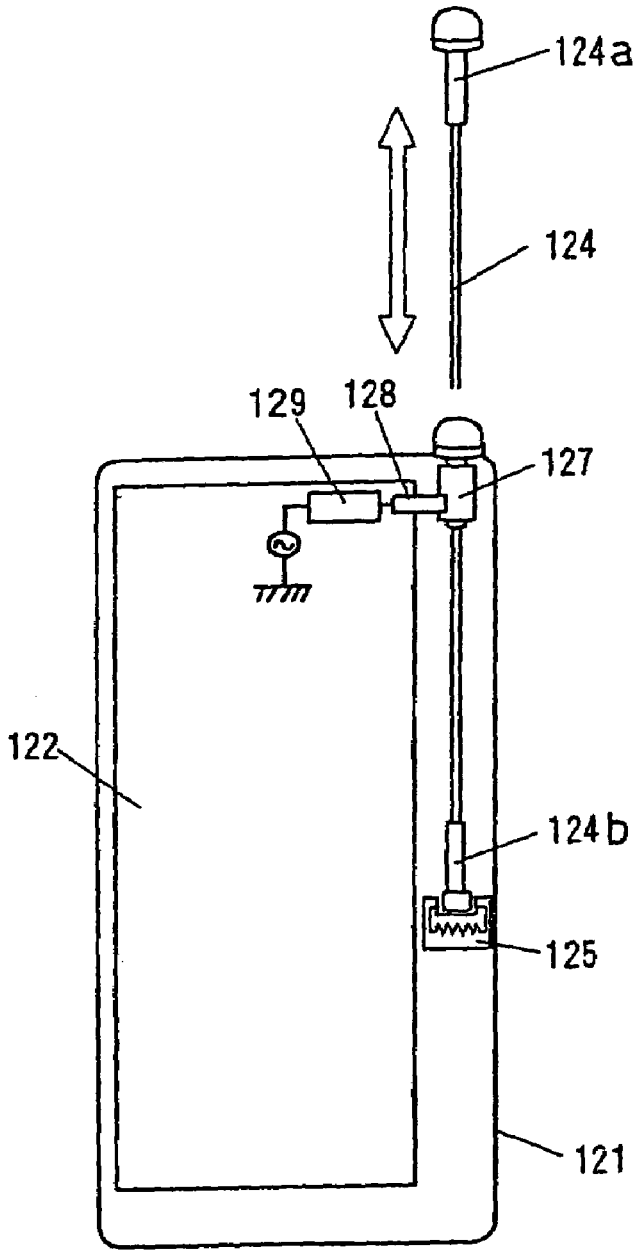
CONVENTIONAL ART FIG.2
FIG. 2 is a view showing another example of a portable wireless communication apparatus having a conventional portable wireless communication apparatus antenna.
Figure 3A:
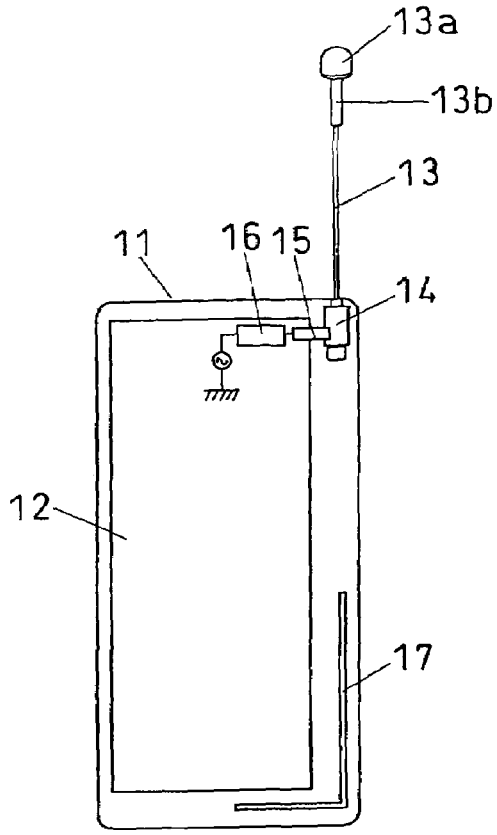
FIG. 3 shows views of a portable wireless communication apparatus having a portable wireless communication apparatus antenna according to an embodiment 1 of the present invention.
Figure 3B:
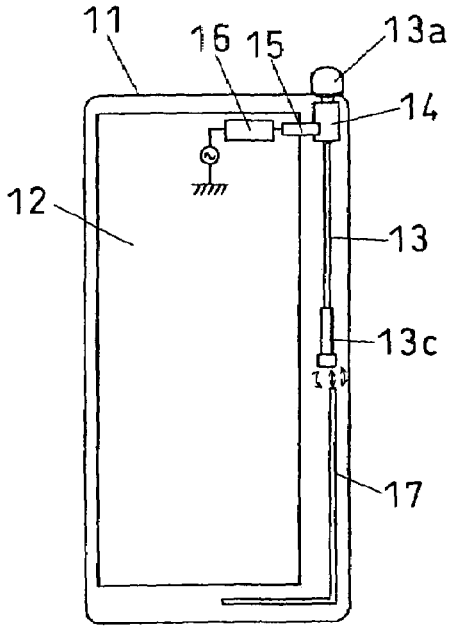
Figure 3C:
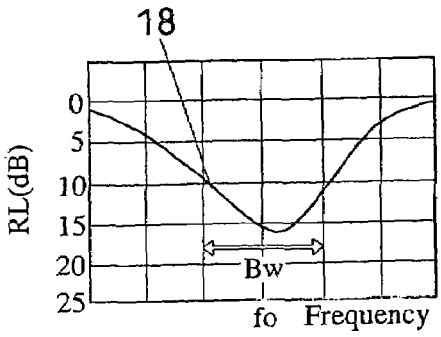
Figure 3D:
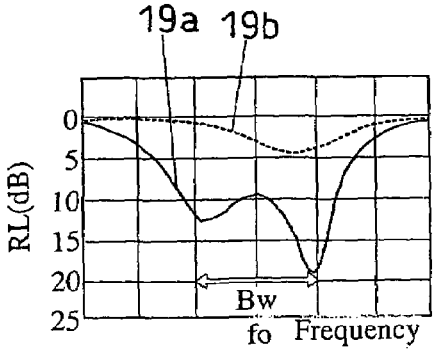

Hereinafter, embodiments of the present invention will be described in detail with reference to the accompanying drawings.

Embodiment 1

FIG. 3 is a view showing a portable wireless communication apparatus having a portable wireless communication apparatus antenna according to an embodiment 1 of the present invention. FIG. 3(*a*) is a view showing a state that the antenna is extended and FIG. 3(*b*) is a view showing a state that the antenna is retracted.

The portable wireless communication apparatus shown in FIG. 3 includes a wireless communication apparatus main body 12 having a printed substrate, a shield, a battery, a display portion, a key portion, and a microphone and a receiver, which are mostly conductive. It also includes resin casing 11 for accommodating the main body of the wireless communication apparatus 12, a first bar-shaped antenna element 13 which is extensible from and retractable in an upper end part of the casing 11, an antenna holder 14 for fastening the first antenna element 13 to the casing, a feeding terminal 15 for connecting the antenna holder 14 to a matching circuit 16 in the wireless communication apparatus main body, and a second antenna element 17 fixedly disposed in the casing 11.

The first antenna element 13 has a resin top 13*a* having a function as a knob when the antenna is extended from the upper end part, an upper connection portion 13*b* provided below the resin top 13*a*, and a lower connection portion 13*c* provided at the lower end part of the first antenna element 13. The first antenna element is inserted in the antenna holder 14 so that it can be slid up and down.

Further, the electrical length of the second antenna element 17 is set at substantially $\lambda/2$ of an operating frequency. The second antenna element 17 is placed such that its upper end part is adjacent to the lower connection portion 13*c* of the first antenna element 13 when it is retracted, and also placed along the side and bottom faces of the casing 11 in a generally L-shaped manner.

With respect to this portable wireless communication apparatus, when the first antenna element 13 is extended from the casing, the lower connection portion 13*c* is in contact with and fastened by the antenna holder 14. Therefore, the first antenna element 13 is connected to the antenna holder 14, the feeding terminal 15 and the matching circuit 16 to operate as a conventional bar-shaped whip antenna.

When the first antenna element 13 is retracted into the casing 11, the upper connection portion 13*b* is in contact with and fastened by the antenna holder 14. At this time, the lower connection portion 13*c* of the first antenna element 13 is adjacent to the end part of the second antenna element 17, and they are capacitively coupled thereby to become integrated with each other and operate as an antenna system. Therefore, the substantial antenna volume increases, and in addition the second antenna element 17 resonates on the operating frequency, thereby realizing double resonance and improving antenna characteristics.

It is more preferable to shift the electrical length of the second antenna element 17 slightly from $\lambda/2$ and to change the resonance frequency suitably at the time when the first antenna element 13 is retracted. In this way, good characteristics can be obtained in a desired band.

FIGS. 3(*c*) and (*d*) show the input return loss characteristics at the time of extending and retracting the antenna, respectively. In FIGS. 3(*c*) and (*d*), abscissas show frequency and ordinates show the input return loss characteristics expressing the matching state of a high frequency circuit. In addition, "$f_0$" on the abscissas represents the center of the operating frequency and "$B_w$" represents the bandwidth of the operating frequency. FIG. 3(*c*) shows the characteristics when the antenna is extended, while FIG. 3(*d*) shows the characteristics when the antenna is retracted. In FIG. 3(*d*), solid line 19*a* represents the characteristics when the second antenna element 17 is provided, and broken line 19*b* represents the characteristics when the second antenna element 17 is not provided.

When the antenna is extended, the antenna operates as a usual bar-shaped whip antenna. Therefore, the antenna volume is sufficiently ensured, and good input return loss characteristics within the operating frequency are exhibited as shown by the solid line 18 of FIG. 3(*c*). In contrast, when the antenna is retracted without the second antenna element 17, the first antenna element 13 is adjacent to the wireless communication apparatus main body 12, which is a conductive member, so that the antenna-occupying volume is decreased. Thus, the input impedance decreases while the frequency characteristics become narrow, as shown by broken line 19*b* of FIG. 3(*d*), so that the input return loss characteristics deteriorate.

However, when the second antenna element 17 is provided, the first and second antenna elements together form an antenna system, thereby causing double resonance. As a result, two dips appear in the input return loss characteristics as shown by the solid line 19*a* of the FIG. 3(*d*), thus exhibiting an extremely wideband characteristic.

According to the present embodiment, even when the first antenna element 13 is completely retracted, it is coupled with the second antenna element 17 placed inside the casing 11, thereby maintaining the antenna-occupying volume and causing double resonance. Thus, good characteristics equivalent to those at the time of extending the antenna can be obtained over a very wide band.

In this embodiment, such a case that the second antenna element 17 is placed along the side and bottom faces of the casing 11 in a generally L-shaped manner is described. However, as long as the electrical length is substantially $\lambda/2$, any shape such as a zigzag shape or coil-like shape may be applicable. Further, if the casing length is long enough to accommodate the second antenna element 17 with the electrical length of $\lambda/2$ in only the side face of the casing, it is not necessary to make the second antenna element 17 in a general L-shaped manner. In addition, the first antenna element 13 that has been described to be extensible and retractable, may be a rotating antenna which is rotatably accommodated in the side of the casing 11 about an axis in the vicinity of the antenna holder 14.

Embodiment 2

Figure 4:
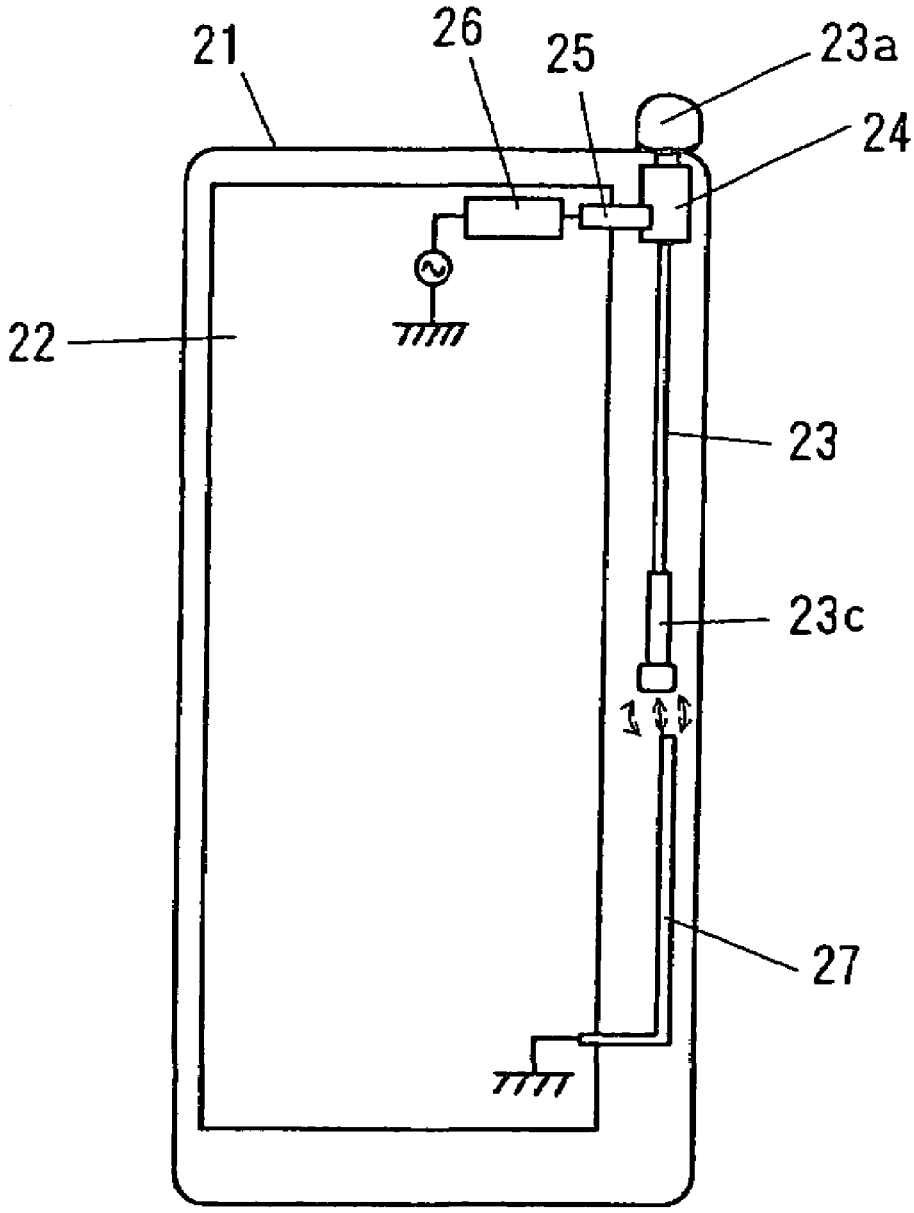
FIG. 4 is a view showing a portable wireless communication apparatus having a portable wireless communication apparatus antenna according to an embodiment 2 of the present invention.

FIG. 4 is a view showing a portable wireless communication apparatus having a portable wireless communication apparatus antenna according to an embodiment 2 of the present invention.

The portable wireless communication apparatus antenna shown in FIG. 4 is an example wherein the second antenna element 17 shown in the above embodiment 1 is miniaturized. In this example, a $\lambda/4$ antenna with a short circuit at one end is placed in the casing as the second antenna element.

The second antenna element 27 is set to substantially $\lambda/4$ of an operating frequency. The upper end part of the element is open, and the lower end part thereof is short-circuited to ground potential by the wireless communication apparatus main body 22. When the antenna is retracted, the lower connection portion 23*c* of the first antenna element 23 is adjacent to the upper end part of the second antenna element 27, and they are capacitively coupled with each other, so that the first and second antenna elements 23 and 27 cause double resonance. As a result, an extremely wideband characteristic can be obtained even when the antenna is retracted. The second embodiment includes a casing 21, an antenna holder 24, a feeding terminal 25, and a matching circuit 26 in the same manner as the embodiment 1.

According to this embodiment, the second antenna element 27 can be reduced in size, and thus the antenna element can be placed in only the side face of the casing even when the casing length is short. Further, since the lower end part of the second antenna element 27 is connected to the wireless communication apparatus main body 22, the high frequency current of the antenna can flow in the wireless communication apparatus main body 22, thereby obtaining a wider band characteristic than the above embodiment 1.

Embodiment 3

Figure 5A:
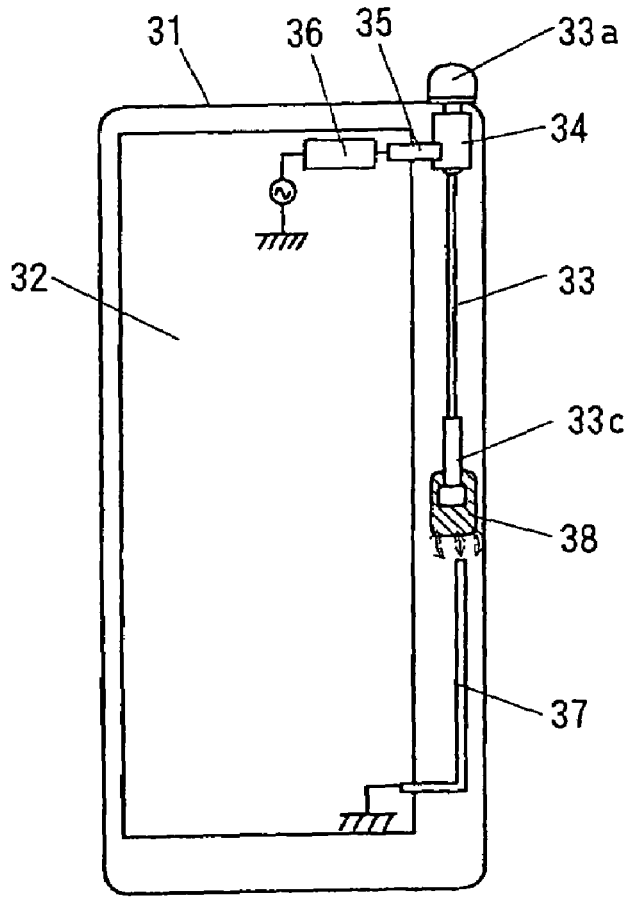
FIG. 5 shows views of a portable wireless communication apparatus having a portable wireless communication apparatus antenna according to an embodiment 3 of the present invention.
Figure 5B:
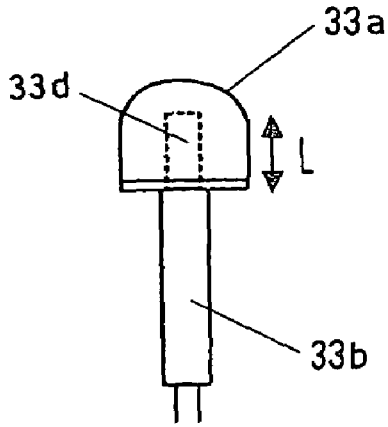

FIG. 5 is a view showing a portable wireless communication apparatus having a portable wireless communication apparatus antenna according to an embodiment 3 of the present invention. FIG. 5(*a*) is a view showing a state that the antenna is retracted, and FIG. 5(*b*) is a magnified view of the top of the antenna.

The portable wireless communication apparatus antenna shown in FIG. 5 is an example wherein the frequency of the first antenna element 23 of the above embodiment 2 is adjusted when it is retracted. Like the above embodiment 2, the third embodiment includes a wireless communication apparatus main body 32, which is mostly constituted by conductive members, a resin casing 31, a bar-shaped retractable first antenna element 33 provided with a resin knob 33*a* on the top thereof, an antenna holder 34, a feeding terminal 35, a second antenna element 37 with a short circuit at one end, which is fixedly disposed in the casing 31, and a frequency conversion portion 38 fixedly disposed in the casing 31 for converting the frequency when the first antenna element 33 is retracted.

The antenna conductive portion 33*d* of the first antenna element 33 is inserted into the resin knob 33*a* only by a length L in order to increase the strength. Therefore, when the antenna is retracted, the length of the antenna is shorter by the length L than that when the antenna is extended. The resonance frequency of the first antenna element 33 thereby increases when retracted, although it depends on the shape of the adjacent wireless communication apparatus main body 32 when retracted. The third embodiment includes an upper connection portion 33*b* and a matching circuit 36 as does embodiment 1.

The frequency conversion portion 38 is electrically connected to the lower connection portion 33*c* when the first antenna element 33 is retracted so as to correct resonance frequency changes (increases) when the first antenna element 33 is retracted.

Figure 6A:
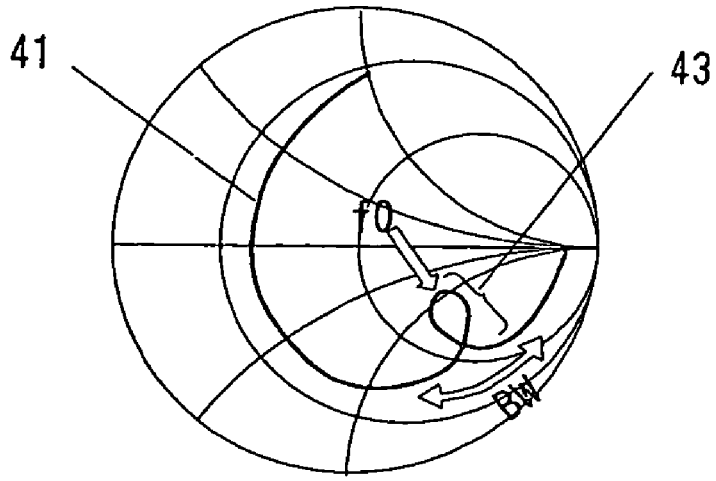
FIG. 6 shows input characteristic diagrams when a frequency conversion portion is not provided.
Figure 6B:
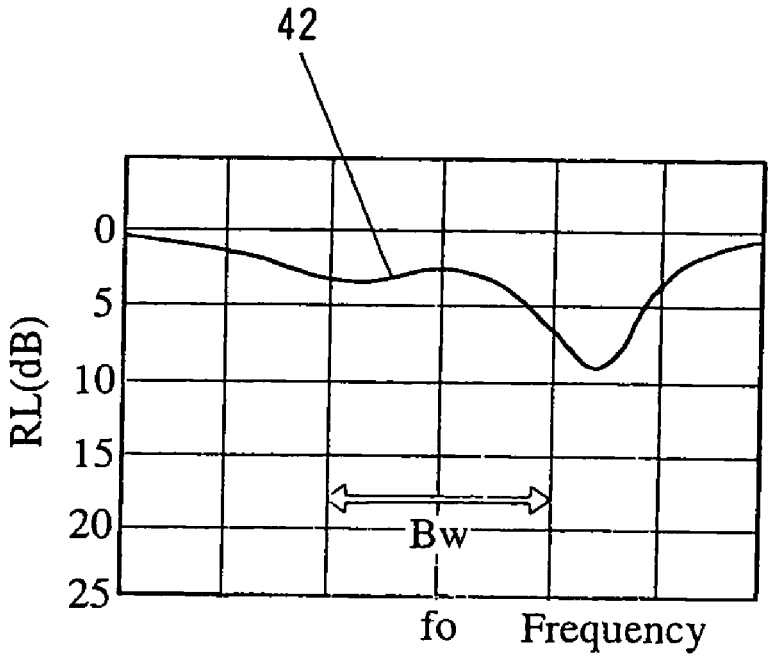
Figure 7A:
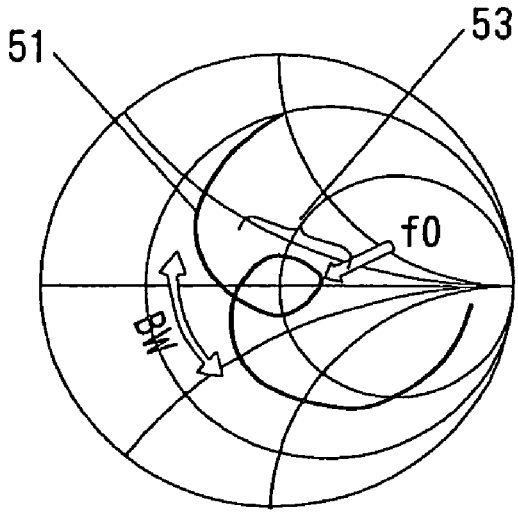
FIG. 7 shows input characteristic diagrams when the frequency conversion portion is provided.
Figure 7B:
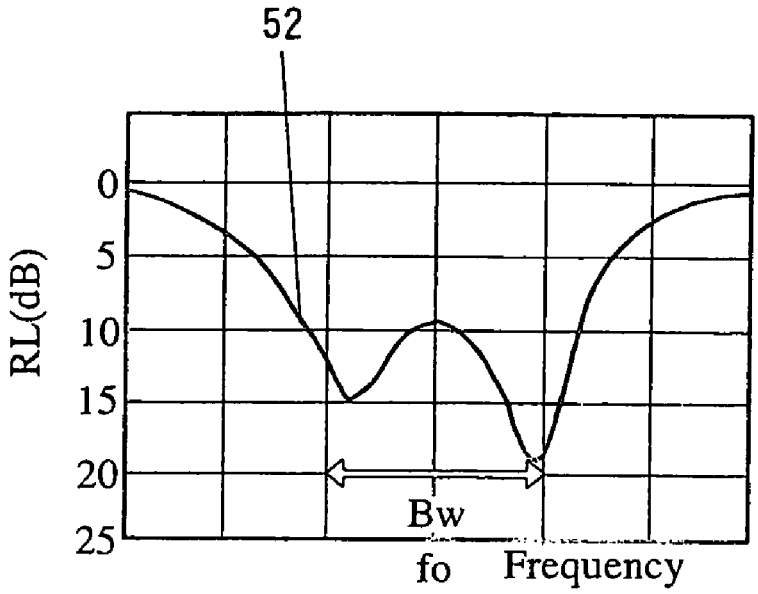

FIG. 6 is an input characteristic diagram when no frequency conversion portion is provided. FIG. 7 is an input characteristic diagram when a frequency conversion portion is provided. Specifically, FIGS. 6 and 7 show the input impedances and the corresponding input return loss characteristics in the absence and presence of the frequency conversion portion 38 when the impedance of a feeding line is 50 Ω. FIGS. 6(*a*) and 7(*a*) show input impedance characteristics 41 and 51 on the Smith chart. FIGS. 6(*b*) and 7(*b*) show input return loss characteristics 42 and 52.

In FIGS. 6 and 7, $f_0$ represents the center frequency and $B_w$ represents the bandwidth of an operating frequency. The small rotations on the Smith chart of FIGS. 6(*a*) and 7(*a*) represent points 43 and 53 of double resonance by the second antenna element 37, and they are present almost at the center frequency in both figures. However, when no frequency conversion portion 38 is provided, the impedance of the double resonance point 43 is apart from 50 Ω and therefore the input return loss characteristic 42 is deteriorated. In contrast, when the frequency conversion portion 38 is provided, the double resonance point 53 shifts around 50 Ω and thus the input return loss characteristic 52 in the operating bandwidth is drastically improved.

While a λ/4 antenna with a short circuit at one end is used as the second antenna element in this embodiment, a λ/2 antenna with both ends open may be used as in embodiment 1.

Figure 8:
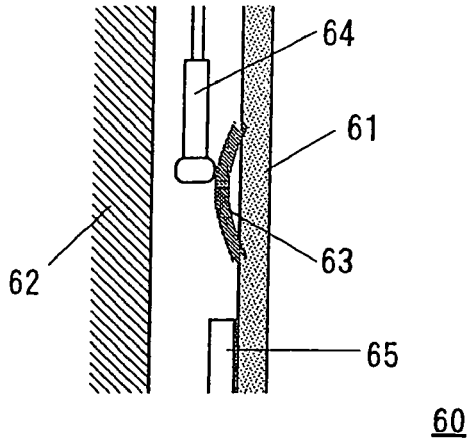
FIG. 8 is a view showing a first example of the frequency conversion portion.

FIG. 8 is a view showing a first example of the frequency conversion portion 38, showing a magnified view of the lower connection end when the first antenna element is retracted.

A frequency conversion portion 60 shown in FIG. 8 comprises an electrically neutral additional conductor 63, which is mounted on the inner face of a resin casing 61 opposing a wireless communication apparatus main body 62. When the first antenna element is retracted, the lower connection portion 64 comes into contact with the additional conductor 63 so that the physical length of the first antenna element when being retracted increases to reduce the resonance frequency. At the same time, the upper end of the second antenna element 65 is placed adjacent to the lower end part of the additional conductor 63 and capacitively coupled therewith.

Figure 9:
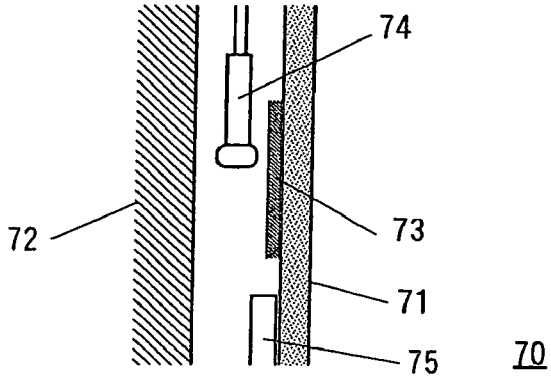
FIG. 9 is a view showing a second example of the frequency conversion portion.

FIG. 9 is a view showing a second example of the frequency conversion portion 38, showing a magnified view of the lower connection portion when the first antenna element is retracted.

A frequency conversion portion 70 shown in FIG. 9 comprises an electrically neutral floating conductor 73, which is mounted on the inner face of a resin casing 71 opposing a wireless communication apparatus main body 72. When the first antenna element is retracted, the lower connection portion 74 is adjacent to the floating conductor 73 in a non-contact condition, thus increasing the electrical length of the retracted first antenna element and reducing the resonance frequency. At the same time, the upper end of the second antenna element 75 is adjacent to the lower end part of the floating conductor 73 and capacitively coupled therewith. Since the floating conductor 73 does not make physical contact with the lower connection portion 74 according to this embodiment, contact deterioration caused by inserting and pulling out the first antenna element does not occur.

Figure 10:
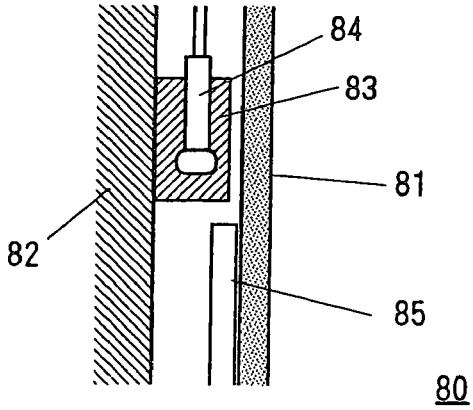
FIG. 10 is a view showing a third example of the frequency conversion portion.

FIG. 10 is a view showing a third example of the frequency conversion portion 38, showing a magnified view of the lower connection portion when the first antenna element is retracted.

A frequency conversion portion 80 shown in FIG. 10 is mounted on a wireless communication apparatus main body 82 and it comprises a capacity loading conductor 83 connected to ground potential. When the first antenna element is retracted, a lower connection portion 84 is adjacent to the capacity loading conductor 83 in a non-contact condition, and thereby the capacity is loaded on the tip of the retracted first antenna element, resulting in a reduced resonance frequency. At the same time, the upper end of a second antenna element 85 is placed adjacent to the lower connection portion 84 of the first antenna element and capacitively coupled.

Since, according to this embodiment, the lower connection portion 84 does not make physical contact with the capacity loading conductor 83 in the same manner as the above second embodiment of the frequency conversion portion, contact deterioration caused by inserting and pulling out the first antenna element does not occur. The frequency conversion portion 38 is not limited to the above embodiments. As long as changes (increases) of the resonance frequency of the first antenna element can be corrected when the first antenna element is retracted, any method can be employed such as adjacent placement of a high dielectric material.

Embodiment 4

Figure 11A:
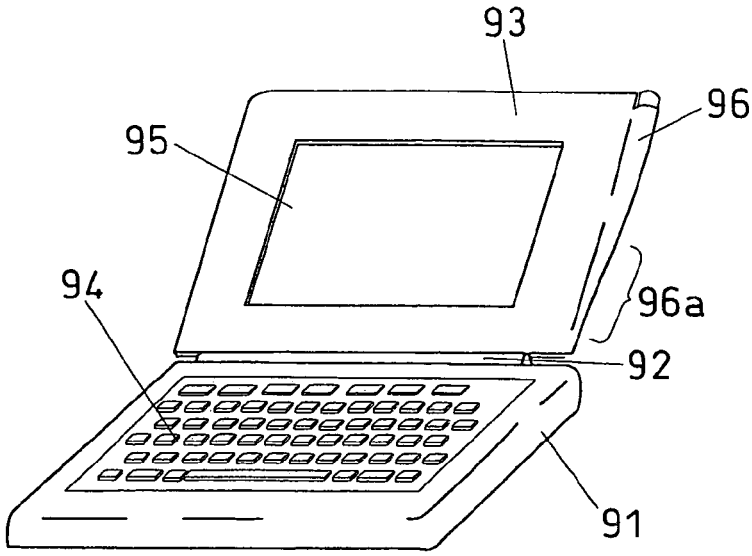
FIG. 11 shows views of a portable wireless communication apparatus having a portable wireless communication apparatus antenna according to an embodiment 4 of the present invention.
Figure 11B:
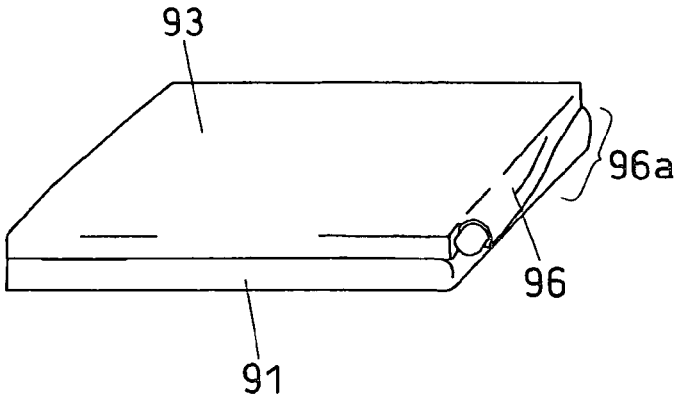
Figure 11C:
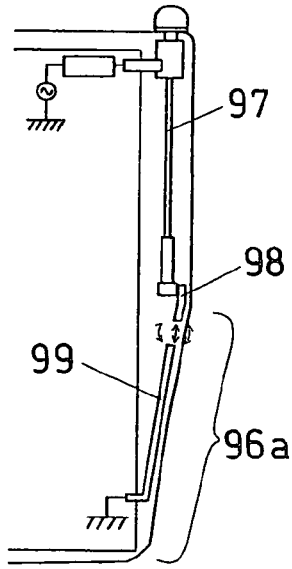

FIG. 11 is a view showing a portable wireless communication apparatus having a portable wireless communication apparatus antenna according to an embodiment 4 of the present invention. Specifically, the figure shows such a case that the portable wireless communication apparatus antenna of the present invention is mounted in a folding-type casing. FIG. 11(*a*) is a perspective view showing an opened state of the casing and FIG. 11(*b*) is a perspective view showing a closed state thereof. FIG. 11(*c*) is a view showing the structure of an antenna portion when it is retracted.

The portable wireless communication apparatus antenna shown in FIG. 11 comprises a first casing 91 and a second casing 93 that is mounted in an openable and closeable manner in the first casing with a hinge portion 92. The first casing 91 has a key portion 94 mounted on the surface thereof, a data processing portion (not shown) internally comprising a CPU and a memory, and a battery (not shown). Further, the second casing 93 has a liquid crystal display 95 mounted on the surface thereof, a wireless communication apparatus portion (not shown) internally provided, and an antenna portion 96 provided at the side end part thereof.

Even when the first and second casings 91 and 93 are closed, that is to say while the wireless communication apparatus is carried, the antenna portion 96 is placed so as not to overlap the first casing 91 (so as to protrude from the first casing 91) and it has a contraction portion 96*a* at the lower end part thereof. The antenna portion 96 is extensible and retractable, and it has a first antenna element 97 with contacting parts at upper and lower ends thereof, an additional conductor 98, which is placed at the side face of the second casing 93 and for adjusting the frequency by coming into contact with the first antenna element 97 when the antenna is retracted, and a second antenna element 99 of $\lambda/4$ with a short circuit at one end. This second antenna element 99 is placed in the contraction portion 96*a* below the additional conductor 98 and the open end thereof is adjacent to the additional conductor 98.

According to this configuration, when the antenna is extended the lower end part of the first antenna element 97 is connected to the wireless communication apparatus portion to operate as a usual whip antenna. Meanwhile, when the antenna is retracted, the first antenna element 97, whose frequency is adjusted by the additional conductor 98 in the same manner as the above embodiments, and the second antenna element 99 have double resonance, and thereby wideband characteristics equivalent to those when the antenna is extended can be obtained.

Moreover, when the second casing 93 overlaps the first casing 91 (closed state), the antenna volume does not decrease because the antenna portion 96 is placed so as to protrude from the first casing 91, and therefore it exhibits wideband characteristics equivalent to those when the casings are opened (open state). At the same time, when the contraction portion 96*a* is provided at the lower part of the second casing 93 as shown in this embodiment, the lower end part of the second antenna element 99 is adjacent to the first and second casings 91 and 93. However, since the lower end part of the second antenna element 99 is present at the side of the short circuit, it is not greatly affected.

According to this embodiment, since the antenna portion 96 is placed at the side of the second casing 93 and the antenna portion 96 protrudes from the first casing 91 even when the casings are closed, the antenna characteristics do not deteriorate. Further, since the antenna portion 96 protrudes from the first and second casings 91 and 93, it can be used as a handgrip for opening or closing the second casing 93. Furthermore, the contraction portion 96*a* is provided at the lower part of the second casing 93, and thereby the first and second casings 91 and 93 are allowed to have identical sizes near the hinge portion 92, so that they have slim shapes.

Embodiment 5

Figure 12A:
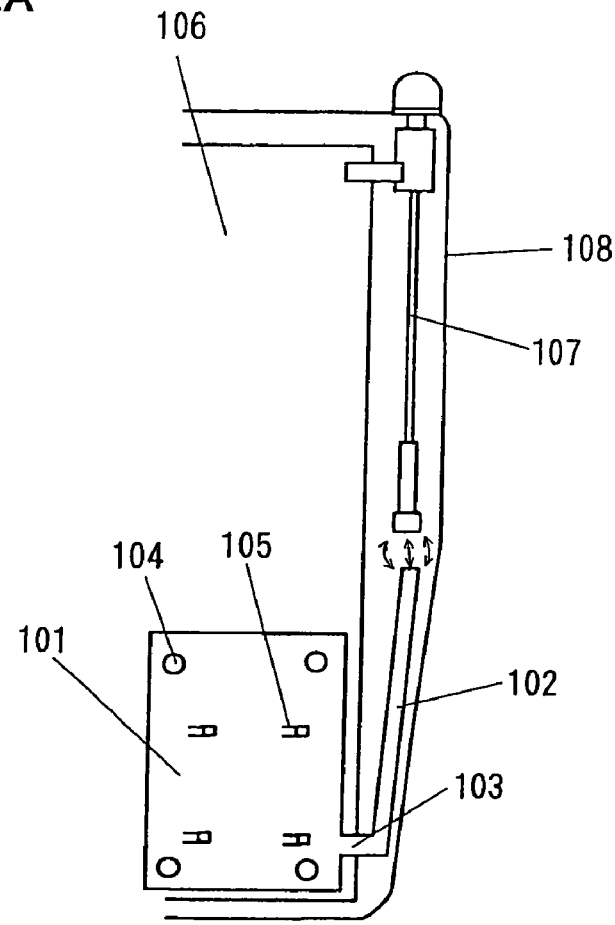
FIG. 12 shows views of the mounting process of the second antenna element of the portable wireless communication apparatus antenna according to an embodiment 5 of the present invention.
Figure 12B:
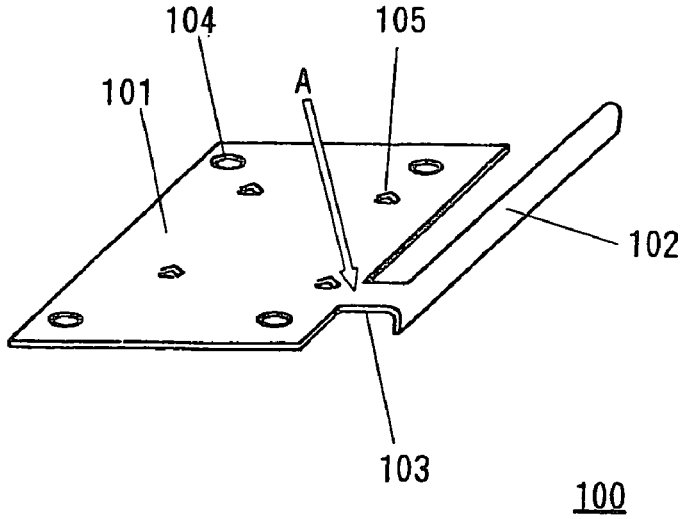

FIG. 12 is a view showing the mounting procedure for the second antenna element of the portable wireless communication apparatus antenna according to an embodiment 5 of the present invention.

FIG. 12(*a*) is a combination view showing that a second antenna portion 100 is placed inside a casing, and FIG. 12(*b*) is a perspective view of the second antenna portion 100.

The second antenna portion 100 shown in FIG. 12 is configured by incorporating a $\lambda/4$ antenna with short circuit at one end into a casing 108, and a plate-like casing mounting portion 101 and a second antenna element 102 are integrally formed of, for example, a steel plate.

The casing mounting portion 101 has a positioning hole 104 and a spring portion for ground contact, formed by bending a part of the steel plate. The second antenna element 102 is connected to the casing mounting portion 101 at a point A of the casing mounting portion 101 by an arm 103. The positioning hole 104 of the casing mounting portion 101 is mounted on a boss of a wireless communication apparatus main body 106 enclosed by a shield inside the casing 108, and fixed so as to be overlapped by the wireless communication apparatus main body 106. At the same time, the spring portion 105 works so as to strengthen the contact with the wireless communication apparatus main body and the ground.

According to this embodiment, the positioning for the mounting of the second antenna portion 100 is fixedly carried out with the boss of the wireless communication apparatus main body 106. The capacitance (interval) between the first and second antenna elements 107 and 102 and the length of the second antenna element 102, which are design parameters for the portable wireless communication apparatus antenna of the present invention, are determined by displacing point A. Therefore, after designing the casing 108 or the wireless communication apparatus main body 106, the above parameters can be changed only by exchanging the second antenna portions 100, thereby dramatically enhancing the degree of freedom and the efficiency of the design.

In this embodiment, a configuration wherein contact with the wireless communication apparatus main body is established with the spring portion is employed. However, when the wireless communication apparatus main body 106 is adjacent to the casing mounting portion 101 in a non-contact condition and an equivalent (RF) contact is established by the capacitance between them, contact is not particularly required. Further, in this embodiment, the casing mounting portion 101 is connected to the ground of the wireless communication apparatus main body 106 and fixed with the boss, but it may be connected to a ground formed of a plated member on the inner wall of the casing and fixed with a fixing means such as a boss formed on the inner wall of the casing.

It should be noted that the present invention is not limited to the above embodiments 1 to 4 and can be realized with various modifications. All publications, patents and patent applications cited herein are incorporated herein by reference in their entirety.

INDUSTRIAL APPLICABILITY

As described above, a portable wireless communication apparatus antenna of the present invention, even when a first antenna element is completely retracted, enables two antennas to operate integrally, so that the antenna volume can be ensured and characteristics equivalent to those when the antenna is extended can be obtained even when it is retracted.

What is claimed is:

1. A portable wireless communication apparatus antenna comprising:

a casing for housing a wireless communication apparatus portion;

a first antenna element which can be extended and retracted by sliding movement relative to said casing and is connected to said wireless communication apparatus portion both when extended and when retracted; and a second antenna element fixedly provided in said casing, wherein when said first antenna element is retracted, said second antenna element is disposed adjacent to said first antenna element in a non-contact condition such that an inner end of said first antenna element is capacitively coupled with an end of said second antenna element in order to operate integrally as an antenna and substantially increase the antenna volume relative to the antenna volume when the first antenna element is extended.

2. The portable wireless communication apparatus antenna according to claim 1, wherein said second antenna element is an antenna element having both ends opened and an electric length of substantially ½ the wavelength of an operating frequency.

3. The portable wireless communication apparatus antenna according to claim 1, wherein said second antenna element is an antenna element having a short circuit at one end and an electric length of substantially ¼ the wavelength of an operating frequency, wherein an open end thereof is placed adjacent to one end part of said first antenna element in a non-contact condition.

4. The portable wireless communication apparatus antenna according to claim 1, wherein said casing comprises two members that are openable and closable via a hinge, and said first or second antenna element is provided on the side face of one of said two members, wherein, when said two members overlap, said first or second antenna element provided on the side face is placed so as to protrude relative to the other member of said two members.

5. A portable wireless communication apparatus comprising said portable wireless communication apparatus antenna of claim 1.

6. A portable wireless communication apparatus antenna comprising:

a casing for housing a wireless communication apparatus portion;

a first antenna element which is extended and retracted by sliding movement relative to said casing and is connected to said wireless communication apparatus portion both when extended and when retracted;

a frequency conversion means fixedly provided in said casing and electrically connected to said first antenna element when said first antenna element is retracted; and a second antenna element fixedly provided in said casing and disposed adjacent to said frequency conversion means in a non-contact condition.

7. The portable wireless communication apparatus antenna according to claim 6, wherein said frequency conversion means is a capacity loading means mounted to a shield of said wireless communication apparatus portion.

8. The portable wireless communication apparatus antenna according to claim 6, wherein said frequency conversion means is an additional conductor that is electrically neutral.

* * * * *

UNITED STATES PATENT AND TRADEMARK OFFICE

CERTIFICATE OF CORRECTION

PATENT NO. : 7,006,045 B2
APPLICATION NO. : 10/468889
DATED : February 28, 2006
INVENTOR(S) : Hiroyuki Takebe It is certified that error appears in the above-identified patent and that said Letters Patent is hereby corrected as shown below:

Face Page, Item (54), change the title from "PORTABLE TRANSCEIVER ANTENNA" to --PORTABLE WIRELESS COMMUNICATION APPARATUS ANTENNA--.

Signed and Sealed this

Third Day of October, 2006

JON W. DUDAS
*Director of the United States Patent and Trademark Office*